US006713692B2

(12) United States Patent
Yamasaki

(10) Patent No.: US 6,713,692 B2
(45) Date of Patent: Mar. 30, 2004

(54) SWITCH MECHANISM, MULTIDIRECTIONAL OPERATION SWITCH, AND MULTIDIRECTIONAL OPERATION UNIT

(75) Inventor: Masato Yamasaki, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/394,064

(22) Filed: Mar. 24, 2003

(65) Prior Publication Data

US 2003/0217910 A1 Nov. 27, 2003

(30) Foreign Application Priority Data

Mar. 26, 2002 (JP) ..... 2002-085262
May 21, 2002 (JP) ..... 2002-145843

(51) Int. Cl.[7] ..... H01H 25/04
(52) U.S. Cl. ..... 200/6 A; 200/5 R; 200/18
(58) Field of Search ..... 200/4, 5 R, 6 A, 200/17 R, 18, 332, 335, 406; 345/157, 161; 463/36–38

(56) References Cited

U.S. PATENT DOCUMENTS 2,849,549 A * 8/1958 Elliott ..... 200/6 A
4,501,939 A * 2/1985 Hyltin et al. ..... 200/6 A
5,889,242 A * 3/1999 Ishihara et al. ..... 200/6 A
6,160,225 A * 12/2000 Isikawa ..... 200/4
6,344,619 B1 * 2/2002 Yamasaki et al. ..... 200/6 A
6,570,107 B1 * 5/2003 Nishimoto et al. ..... 200/6 R
6,586,690 B2 * 7/2003 Shimomura et al. ..... 200/6 A

* cited by examiner

*Primary Examiner*—Michael A. Friedhofer
(74) *Attorney, Agent, or Firm*—Wenderoth, Lind & Ponack, L.L.P.

(57) ABSTRACT

A switch mechanism, and a multidirectional operation switch and multidirectional operation unit employing this switch mechanism. The switch mechanism has a flexible contact, multiple fixed contacts, and multiple common contacts. Multiple fixed contacts are disposed facing the flexible contact, and include multiple first common contacts and multiple second common contacts for common electrical coupling, and multiple independent contacts which are electrically independent. These fixed contacts are aligned in a group of the first common contact, independent contact, second common contact, and independent contact. This group is disposed repeatedly in the clockwise or counterclockwise sequence. The flexible contact touches the first or second common contacts and one independent contact adjacent to the common contact for electrically coupling the common contact and independent contact.

8 Claims, 11 Drawing Sheets

SWITCH MECHANISM, MULTIDIRECTIONAL OPERATION SWITCH, AND MULTIDIRECTIONAL OPERATION UNIT

FIELD OF THE INVENTION

The present invention relates to switch mechanisms, and multidirectional operation switches and multidirectional operation units employing switch mechanisms. These are mainly used for input panels of mobile communications equipment such as mobile phones and pagers, and small and multifunctional electronic apparatuses such as remote controls, audio equipment, games machines, car navigation systems, and digital cameras.

BACKGROUND OF THE INVENTION

A multidirectional operation switch employing a conventional switch mechanism is described next with reference to FIGS. 10 to 13.

FIG. 10 is a front section view of a conventional multidirectional operation switch.

FIG. 11 is an exploded perspective of the same switch. In the multidirectional operation switch in FIGS. 10 and 11, box case 31 made of insulating resin has a cavity at its center. The open top of this cavity is covered with cover 32, typically made of a metal sheet.

FIG. 12 is a plan view of box case 31.

As shown in FIG. 12, common fixed contact 53 and eight inner fixed contacts 33 to 40 are fixed on the bottom face of the cavity of box case 31, typically by insert molding.

The rim of dome-shaped flexible contact 41 made of a thin resilient metal sheet is placed on common fixed contact 53. All eight inner fixed contacts 33 to 40 are disposed inside common fixed contact 53 on a circumference centering on the center of box case 31 at equal intervals.

These fixed contacts 53 and 33 to 40 are electrically coupled to lead-out terminals 63 and 43 to 50 disposed on the outer face of box case 31.

The above common fixed contact 53 is a contact used commonly for electrical coupling with other inner fixed contacts 33 to 40 (hereafter referred to as a common contact). A lead-out terminal electrically coupled to fixed contact 53 is called common terminal 63.

The cavity of box case 31 is octagonal when seen from the top, and its inner wall has eight corners 31A.

Operating member 42 has shaft 42B and octagonal flange 42A at the bottom of shaft 42B. Flange 42 is made integrally with shaft 42B. Operating member 42 is placed such that shaft 42B protrudes upward from through hole 32A at the center of cover 32, and flange 42A is housed inside the cavity of box case 31. Operating member 42 is thus placed inside box case 31, allowing a tilting operation, but restricting the rotation by inner wall corners 31A.

On the bottom face of flange 42A of operating member 42, eight pushing elements 42D, in total, are provided at positions corresponding to inner fixed contacts 33 to 40 on the bottom face of box case 31.

Dome-shaped flexible contact 41 is positioned by a circular bottom area formed by the inner wall of box case 31 such that its center and the center of operating member 42 match, and placed on common contact 53.

Pushing element 42D contacts the top face of this dome-shaped flexible contact 41. This makes the top face of flange 42A of operating member 42 resiliently contact the bottom face of cover 32 so that operating member 42 is maintained in a vertical neutral position.

Next, the operation of the conventional multidirectional operation switch as configured above is described.

First, in the normal state, as shown in FIG. 10, connection between any pair of the contacts is in the OFF state FIG. 13 is a front sectional view of operating member 42 during tilting operation.

Key 52 is mounted on top end 42C of shaft 42B of operating member 42. When the left top face of key 52 is pressed, as shown by arrow 212 in FIG. 13, operating member 42 tilts about a fulcrum at the right top face of flange 42A.

Pushing element 42D on the bottom face corresponding to the tilting direction of operating member 42 then pushes dome-shaped flexible contact 41 and partially inverts dome-shaped flexible contact 41. Then, dome-shaped flexible contact 41 provides tactile 'click' and contacts inner fixed contact 34 at the left bottom of box case 31 to turn ON between common contact 53 and inner fixed common contacts 34. Here, only lead-out common terminal 63 and terminal 44 are electrically coupled.

When the pushing force applied to key 52 is released, pushing element 42D on the bottom face of operating member 42 is pushed back due to the resilience of dome-shaped flexible contact 41, and operating member 42 returns to the vertical neutral position.

In the same way, common terminal 63 and one of the lead-out terminals 43 to 50 corresponding to each pushing position are electrically coupled when a different part of key 52 is pushed.

The above multidirectional operation switch with the conventional switch mechanism has terminals 43 and 50 to 63 corresponding respectively to inner fixed contacts 33 to 40 and common contact 53. Accordingly, the large numbers of terminals hinders downsizing of such multidirectional operation switches.

SUMMARY OF THE INVENTION

The present invention aims to offer a smaller switch mechanism with fewer terminals, and a multidirectional operation switch and multidirectional operation unit using this switch mechanism.

The switch mechanism of the present invention includes a flexible contact and multiple fixed contacts. The multiple fixed contacts are disposed such as to face the flexible contact, and include i) multiple first common contacts used commonly for electrical coupling; ii) multiple second common contacts used commonly for electrical coupling; and iii) multiple independent contacts which are electrically independent.

The multiple fixed contacts are disposed such that they are aligned clockwise or counterclockwise repeatedly in a group in the sequence of: first common contact, independent contact, second common contact, and independent contact. In fixed contacts, two adjacent contacts are electrically coupled when the flexible contact touches the two adjacent fixed contacts.

Since the multiple fixed contacts are disposed in the sequence as described above, the first common contacts or second common contacts and the independent contact adjacent to it are electrically coupled.

In the multidirectional operation switch of the present invention, the multiple fixed contacts are disposed on the inner bottom of the box case made of insulating resin which has an open top.

In addition, a dome-shaped flexible contact made of a thin resilient metal sheet is disposed inside the box case such as to cover the multiple fixed contacts.

A cover with a through hole covers the opening of the box case.

An operating member is configured with a shaft, flange, and pushing element which are integrally molded.

The shaft protrudes upward from the through hole. The flange is formed at the bottom end of the shaft, and its periphery is tiltably supported by an inner wall of the cavity of the case. The pushing element is disposed on the bottom face of the flange in a position respectively corresponding to the intermediate position between adjacent fixed contacts so as to contact the dome-shaped flexible contact.

The multiple fixed contacts include i) multiple first common contacts used commonly for electrical coupling; ii) multiple second common contacts used commonly for electrical coupling; and iii) multiple independent contacts which are electrically independent These multiple fixed contacts are disposed such that they are aligned clockwise or counterclockwise repeatedly in a group in the sequence of: one first common contact, one independent contact, one second common contact, and another one independent contact.

The dome-shaped flexible contact is pressed by the pushing element and contacts two adjacent fixed contacts. This makes the two adjacent fixed contacts electrically coupled. More specifically, the first common contact or second common contact and the independent contact adjacent to it are electrically coupled.

In the multidirectional operation unit of the present invention, the multiple fixed contacts are disposed on a wiring board facing the flexible contact. The multiple fixed contacts include i) multiple first common contacts used commonly for electrical coupling; ii) multiple second common contacts used commonly for electrical coupling; and iii) multiple independent contacts which are electrically independent.

These multiple fixed contacts are disposed such that they are aligned clockwise or counterclockwise repeatedly in a group in the sequence of: one first common contact, one independent contact, one second common contact, and another one independent contact. In these fixed contacts, adjacent two fixed contacts, i.e., the first common contact or second common contact and the independent contact adjacent to it, are electrically coupled when the flexible contact touches these two adjacent fixed contacts.

DETAILED DESCRIPTION OF THE PREFERRED EMBODIMENTS

A switch mechanism of the present invention, and a multidirectional operation switch and multidirectional operation unit employing this switch mechanism are described below with reference to FIGS. 1 to 9.

First Embodiment

Figure 1:
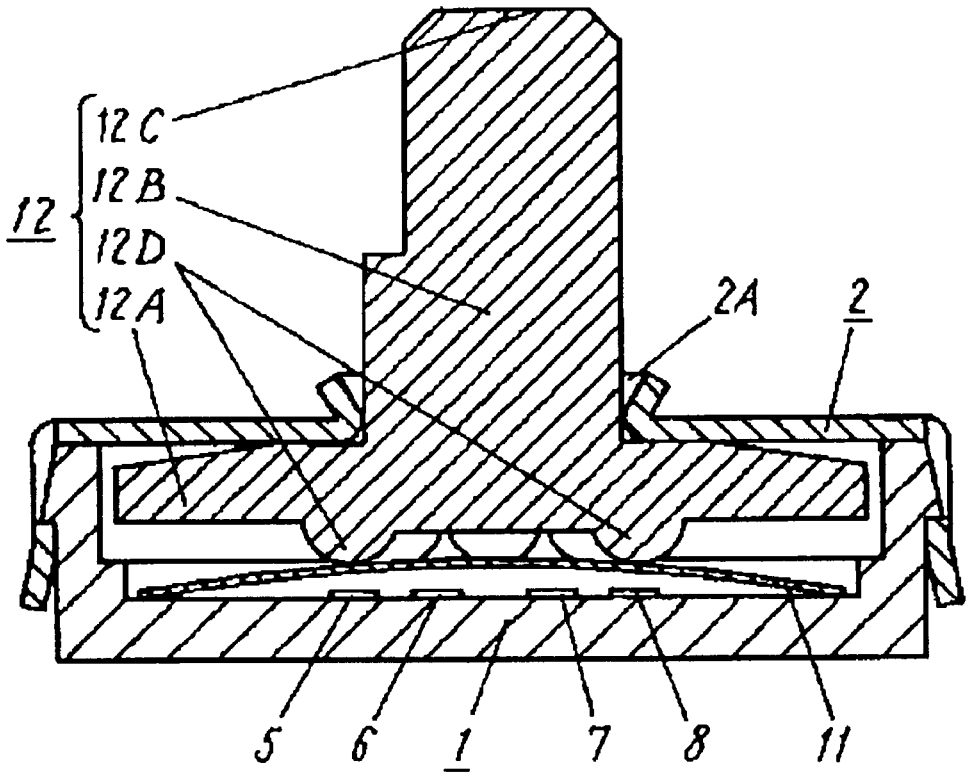
FIG. 1 is a front section view of a multidirectional operation switch in accordance with a first exemplary embodiment which has a switch mechanism of the present invention.

FIG. 1 is a front section view of the multidirectional operation switch in a first exemplary embodiment having the switch mechanism of the present invention.

Figure 2:
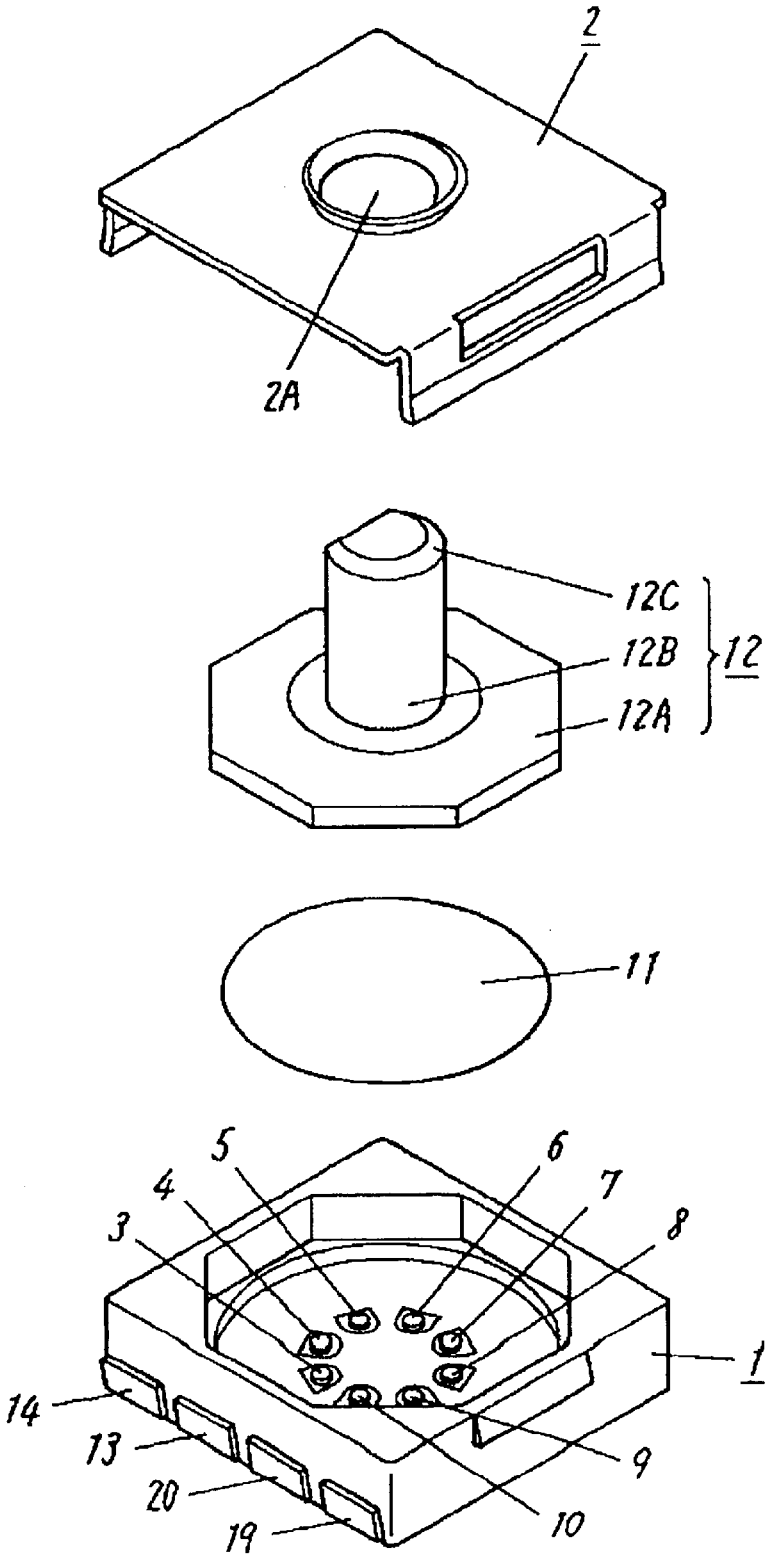
FIG. 2 is an exploded perspective of the multidirectional operation switch in accordance with the first exemplary embodiment of the present invention.

FIG. 2 is an exploded perspective of the above switch.

In FIGS. 1 and 2, box case 1 is made of an insulating resin, and has a cavity with an open top.

Dome-shaped flexible contact 11 is made of a convex-shaped thin resilient metal sheet.

Dome-shaped flexible contact 11 is housed in the cavity of box case 1 such that its center is positioned at the center of the cavity.

Operating member 12 is disposed on dome-shaped flexible contact 11.

Operating member 12 is configured with shaft 12B and flange 12A at the bottom which is integrally formed with shaft 12B. Over this flange 12A, cover 2, typically made of a metal sheet, covers the top opening of box case 1, and is fixed to box case 1.

Both the cavity of box case 1 and flange 12A of operating member 12 are octagonal, and are configured to prevent any rotation by flange 12A. Shaft 12B of operating member 12 protrudes from through hole 2A at the center of cover 2 for a tilting operation.

Figure 3:
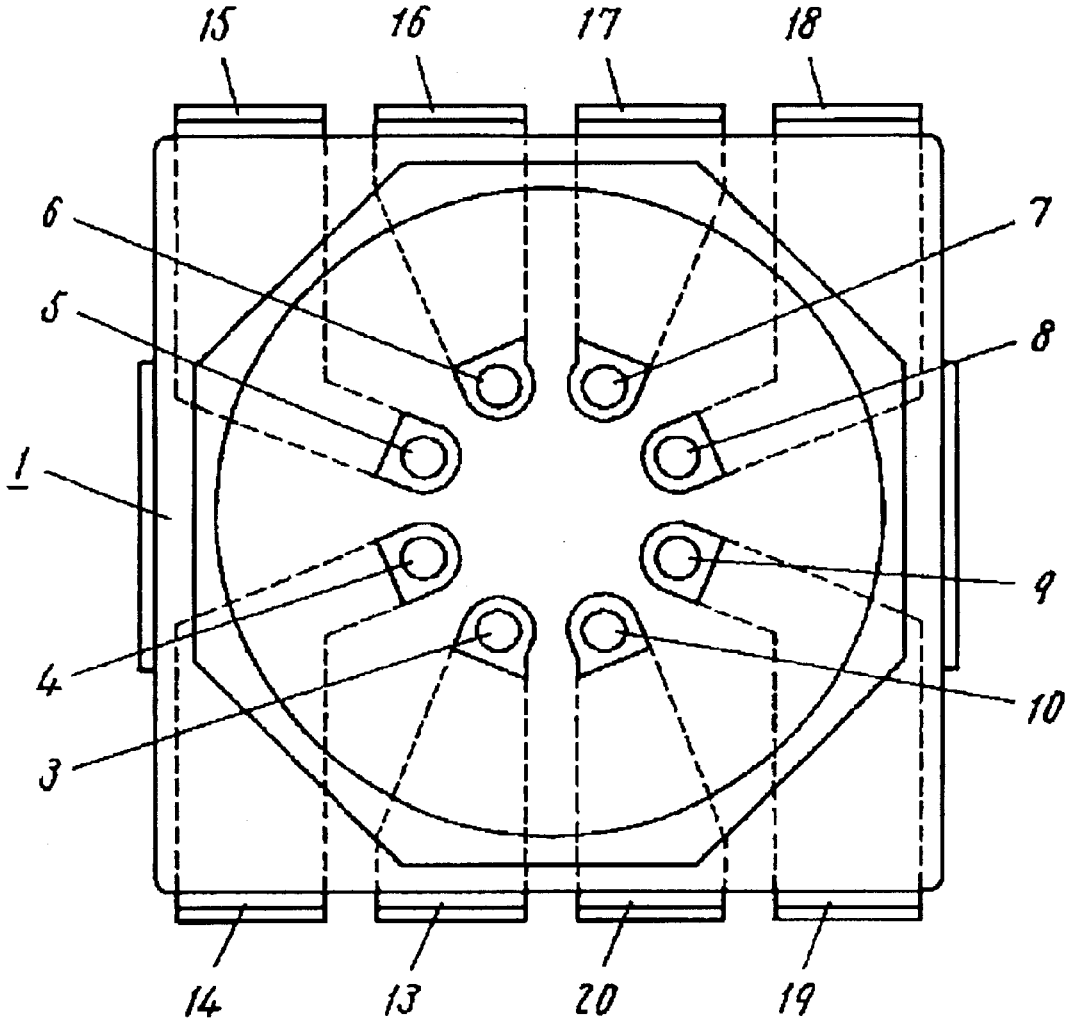
FIG. 3 is a plan view of a box case of the multidirectional operation switch in accordance with the first exemplary embodiment of the present invention.

As shown in FIG. 3, eight fixed contacts 3, 4, 5, 6, 7, 8, 9, and 10 are disposed at the cavity bottom of box case 1 along the circumference of a circle centering on the center of box case 1 at positions dividing the circumference into 8 equal portions. In addition, fixed contacts 3 to 10 are disposed inside the rim of dome-shaped flexible contact 11 projected onto the bottom face of the cavity of box case 1. Fixed contacts 3 to 10 are fixed on the cavity bottom of box case 1, typically by insert molding.

Fixed contacts 3 to 10 include the following three types of contacts.

i) First common contacts 3 and 7 which have electrically the same potential and are commonly used.

ii) Second common contacts 5 and 9 which have electrically the same potential and are commonly used.

iii) Independent contacts 4, 6, 8, and 10 which are electrically independent.

As described above, there are two systems of common contacts.

Each contact is disposed in the clockwise sequence of first common contact 3, independent contact 4, second common contact 5, independent contact 6, first common contact 7, independent contact 8, second common contact 9, and independent contact 10.

In other words, the fixed contacts are aligned regularly such that the common contact and independent contact are disposed alternately, and the first common contact and second common contact are also disposed alternately. In addition, a group in the sequence of the first common contact, independent contact, second common contact, and independent contact is disposed repeatedly in turn on the circumference.

First common contacts 3 and 7, second common contacts 5 and 9, and independent contacts 4, 6, 8, and 10 which are electrically independent are electrically coupled respectively to first common terminals 13 and 17; second common terminals 15 and 19; and independent terminals 14, 16, 18, and 20, which are disposed outside case 1 for lead-out.

Terminals 13 to 20 are disposed, four each, to the opposing outer walls of box case 1.

In the above description, four terminals, in total, that are first common terminals 13 and 17 and second common terminals 15 and 19, are provided as terminals for first common contacts 3 and 7 and second common contacts 5 and 9. Alternatively, first common contacts 3 and 7 may be connected and second common contacts 5 and 9 may be connected in box case 1 respectively for providing only one terminal each for first and second common contacts as first common terminal and second common terminal.

On the bottom face of flange 12A of operating member 12, eight pushing elements 12D are provided.

Pushing elements 12D are disposed at the middle of adjacent contacts among contacts 3 to 10, and protrude downward from flange 12A.

Pushing elements 12D contact the top face of dome-shaped flexible contact 11 positioned by and housed in box case 1. This makes the top face of flange 12A of operating member 12 push against the bottom of cover 2, making operating member 12 maintain its vertical neutral position.

Next, the operation of the multidirectional operation switch as configured above is described.

Firstly, FIG. 1 shows the normal state when connection between any pair of the contacts is in the OFF state.

Figure 4:
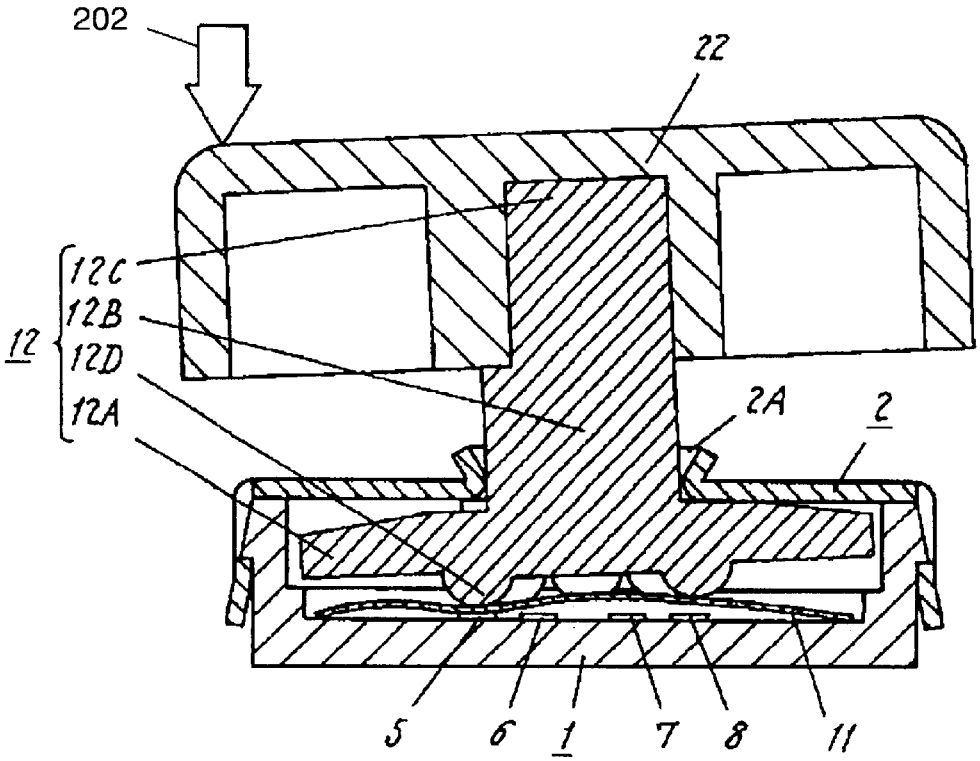
FIG. 4 is a front section view illustrating the tilting state of the multidirectional operation switch in accordance with the first exemplary embodiment of the present invention.

Then, as shown by arrow 202 in FIG. 4, a left top face of key 22 mounted on top end 12C of operating member 12 is pushed downward. In other words, shaft 12B is tilted toward the intermediate position between independent contact 4 and second common contact 5. Here, operating member 12 tilts about a fulcrum at the right top of flange 12A. This makes pushing element 12D on the left bottom face of flange 12A push dome-shaped flexible contact 11 and partially invert it. Dome-shaped flexible contact 11 provides a tactile 'click' and its inverted portion contacts independent contact 4 and second common contact 5 disposed at the bottom of box case 1. Accordingly, independent terminal 14 and second common terminal 15 for lead-out come into contact.

FIG. 4 only illustrates the case when dome-shaped flexible contact 11 contacts second common contact 5. However, dome-shaped flexible contact 11 pushed by pushing element 12D is also contacting independent contact 4 although it is not illustrated.

Since only a portion of dome-shaped flexible contact 11 pushed by pushing element 12D is inverted, dome-shaped flexible contact 11 does not contact fixed contacts 3 and 6 to 10 which are out of the direction that shaft 12B tilts.

When the pressing force applied to key 22 is released, the resilience of dome-shaped flexible contact 11 pushes back pushing element 12D on the bottom face of operating member 12, and operating member 12 returns to its vertical neutral position. Dome-shaped flexible contact 11 separates from independent contact 4 and second common contact 5, and the switch returns to the OFF state.

In the same way, one of the first and second common contacts and one of the independent contacts are electrically coupled in response to the respective tilting direction of operating member 12 via dome-shaped flexible contact 11 by changing the direction in which key 22 is pushed, i.e., changing the direction in which operating member 12 is tilted. More specifically, one of first common terminals 13 and 17 or one of second common terminals 15 and 19 and one of lead-out terminals 14, 16, 18, and 20 are electrically coupled.

As described above, multiple contacts are provided under and inside an area of one dome-shaped flexible contact 11 in the multidirectional operation switch having the switch mechanism of the present invention. These multiple contacts consist of three types: two systems of common contacts, i.e., first common contacts 3 and 7 and second common contacts 5 and 9 which have electrically the same potential and are used commonly; and independent contacts 4, 6, 8, and 10 which are electrically independent.

Contacts 3 to 10 are aligned in the clockwise sequence of first common contact 3, independent contact 4, second common contact 5, independent contact 6, first common contact 7, independent contact 8, second common contact 9, and independent contact 10. In other words, the common contact and independent contact are disposed alternately, and the first common contact and second common contact are also disposed alternately as common contacts. This makes it possible to switch a pair of common contact and independent contact when operating member 12 is tilted in a given direction. Accordingly, the direction of operation can be specified.

As shown in FIG. 3, it is apparent that contacts 3 to 10 can be disposed counterclockwise.

Moreover, with respect to two systems of common contacts, multiple common contacts in each system can be commonly connected to one terminal respectively for lead-out. This enables the reduction of the number of lead-out terminals, offering a downsized switch.

Next, the number of input ports required in a microcomputer (not illustrated) for receiving and processing ON and OFF signals from this switch are described.

Figure 12:
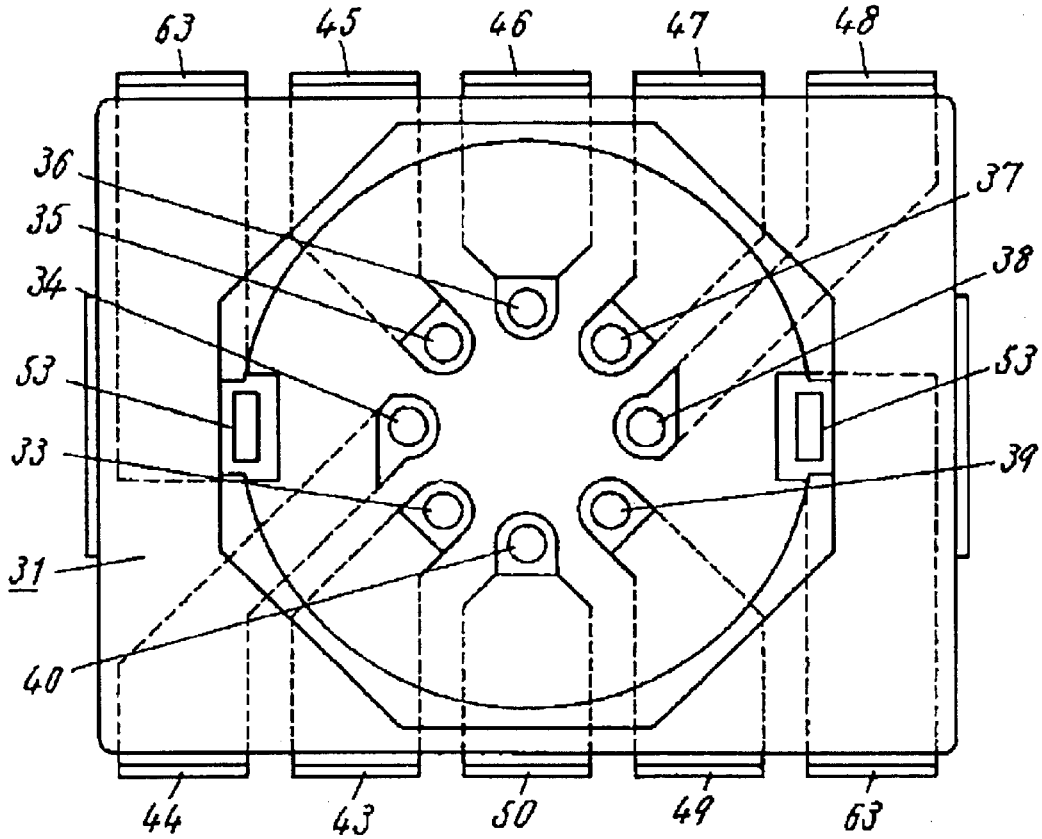
FIG. 12 PRIOR ART
FIG. 12 is a plan view of a box case of the conventional multidirectional operation switch.
Figure 13:
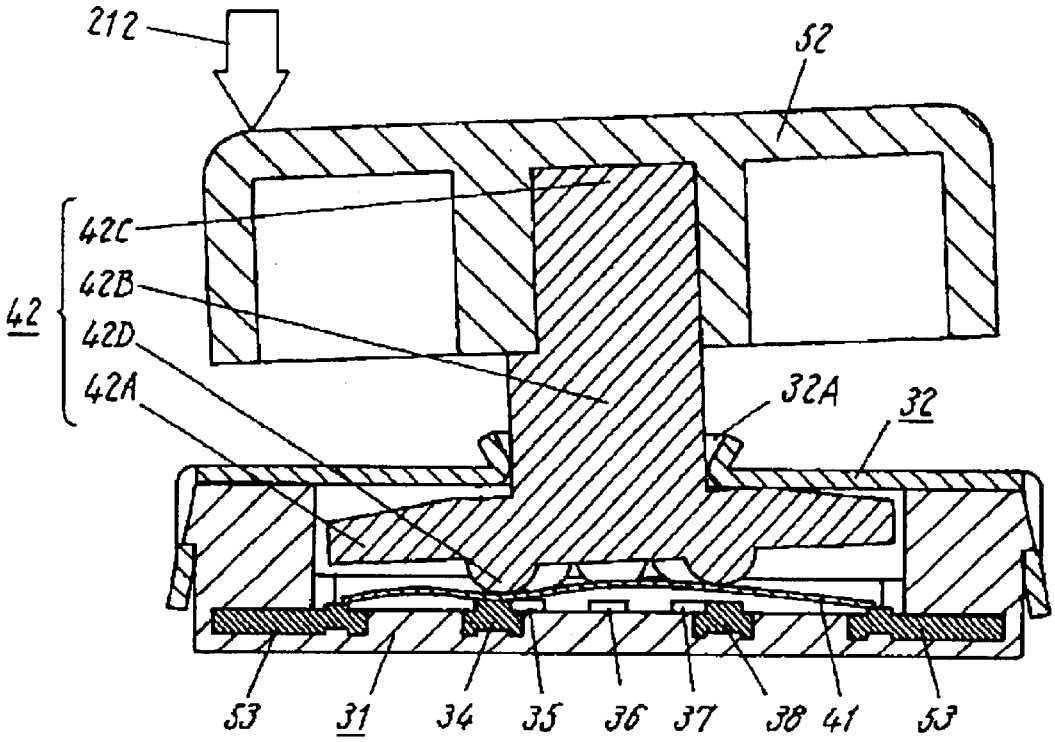
FIG. 13 PRIOR ART
FIG. 13 is a front section view illustrating the tilting state of the conventional multidirectional operation switch.

For the conventional switch mechanism as described with reference to FIG. 12, common terminal 63 is connected to the ground and eight terminals are needed for connecting the remaining terminals 43 to 50.

On the other hand, the switch mechanism of the present invention can be configured, in total, with six terminals: first common terminal, second common terminal, and four independent terminals. Accordingly, two input ports can be eliminated. This offers a design-friendly switch which enables more simplified circuit design, typically of wiring boards in an apparatus.

Figure 5:
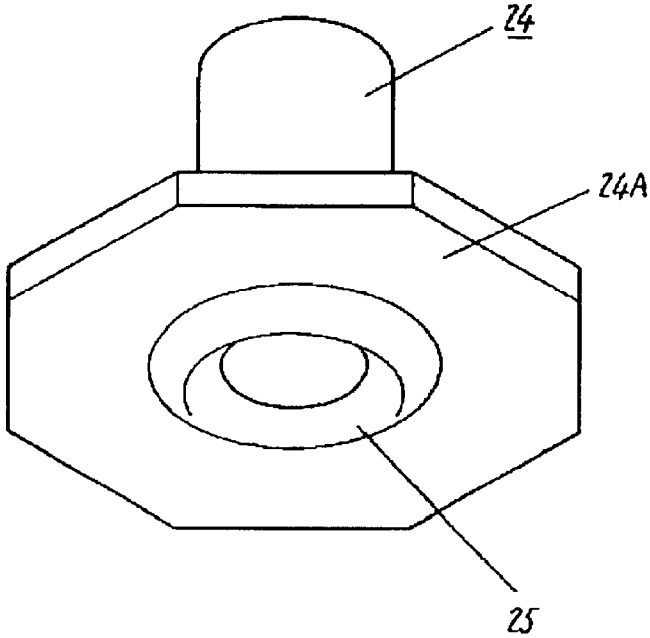
FIG. 5 is a perspective, seen from the bottom, of an operating element in another configuration in the multidirectional operation switch in accordance with the first exemplary embodiment of the present invention.

FIG. 5 is a perspective seen from the bottom of the operating member in another configuration. Pushing element 25 on the bottom face of flange 24A of operating member 24 can result in a shape protruding toroidally at an area corresponding to contacts 3 to 10 at the cavity bottom of box case 1.

Pushing element 25 with the shape shown in FIG. 5 enables the further reduction of incorrect operation of the switch, compared to the aforementioned configuration.

The reasons are given next.

Pushing element 25 results in a uniform height through the circumference. If operating member 24 tilts directly to the fixed contact, which is out of the given operating directions, toward the direction of second common contact 5, for example, the portion of dome-shaped flexible contact 11 pressed by the portion of annular pushing element 25 corresponding to the tilted direction is inverted. This partial inversion of dome-shaped flexible contact 11 is halted when it contacts second common contact 5. In other words, the tilting movement of operating member 24 in the tilting direction is halted when dome-shaped flexible contact 11 touches second common contact 5. Dome-shaped flexible contact 11 is thus prevented from contacting independent contact 4 or 6 adjacent to second common contact 5, maintaining the OFF state between contacts. Accordingly, incorrect operation of the switch by operating to this direction can be reduced.

The first exemplary embodiment describes an example of a switch mechanism having eight fixed contacts. The idea of the switch mechanism of the present invention is also applicable to other switch mechanisms having fixed contacts in multiples of 4.

In the switch mechanism of the present invention, a conductor other than a dome-shaped flexible contact can be used for electrically coupling fixed contacts as aligned above.

Second Embodiment

An apparatus equipped with the switch mechanism as described in the first exemplary embodiment is briefly described in a second exemplary embodiment.

Figure 6:
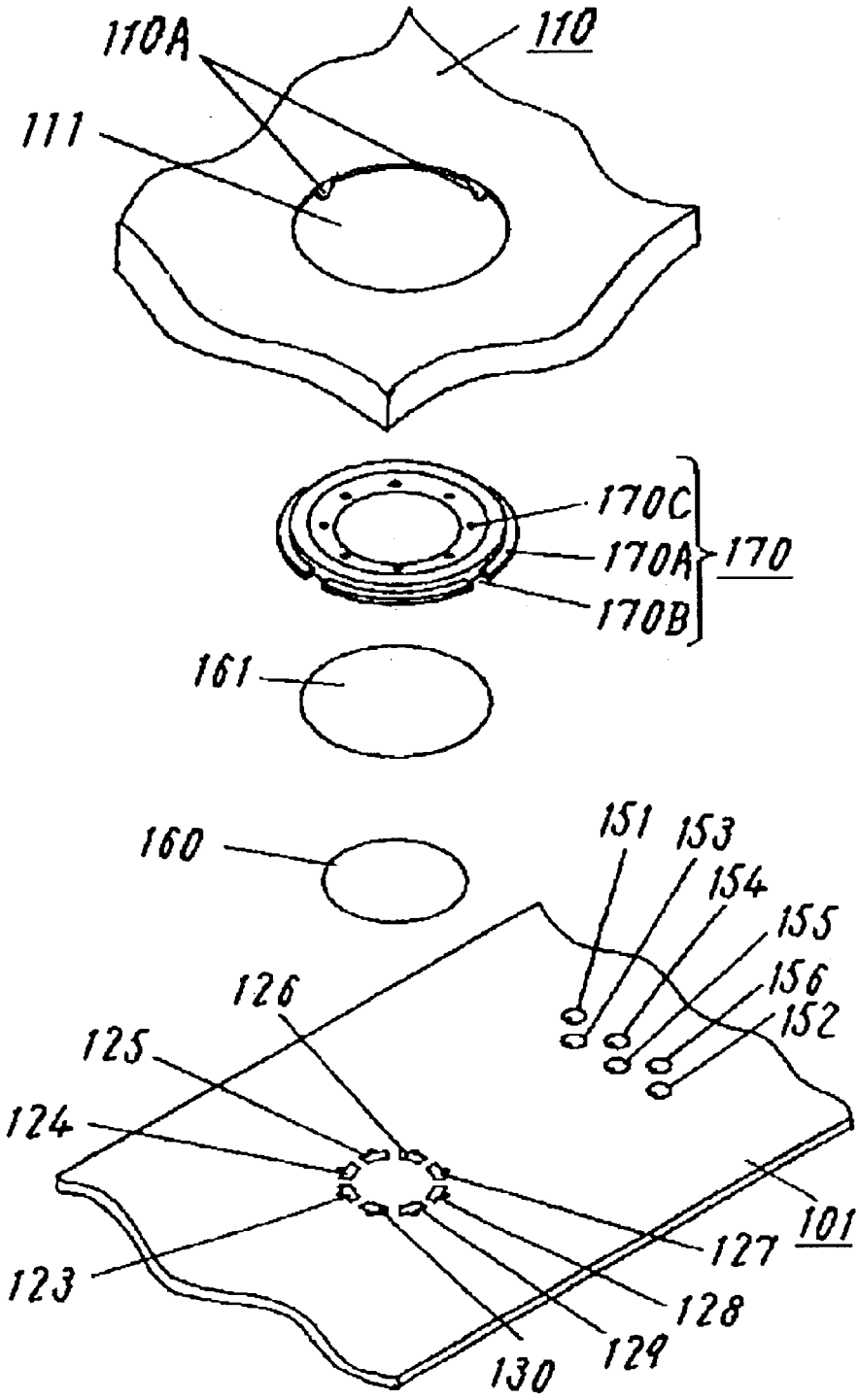
FIG. 6 is an exploded perspective of a multidirectional operation unit in accordance with a second exemplary embodiment of the present invention which has the switch mechanism of the present invention.

FIG. 6 is an exploded perspective of a multidirectional operation unit in the second exemplary embodiment equipped with the switch mechanism of the present invention.

Figure 7:
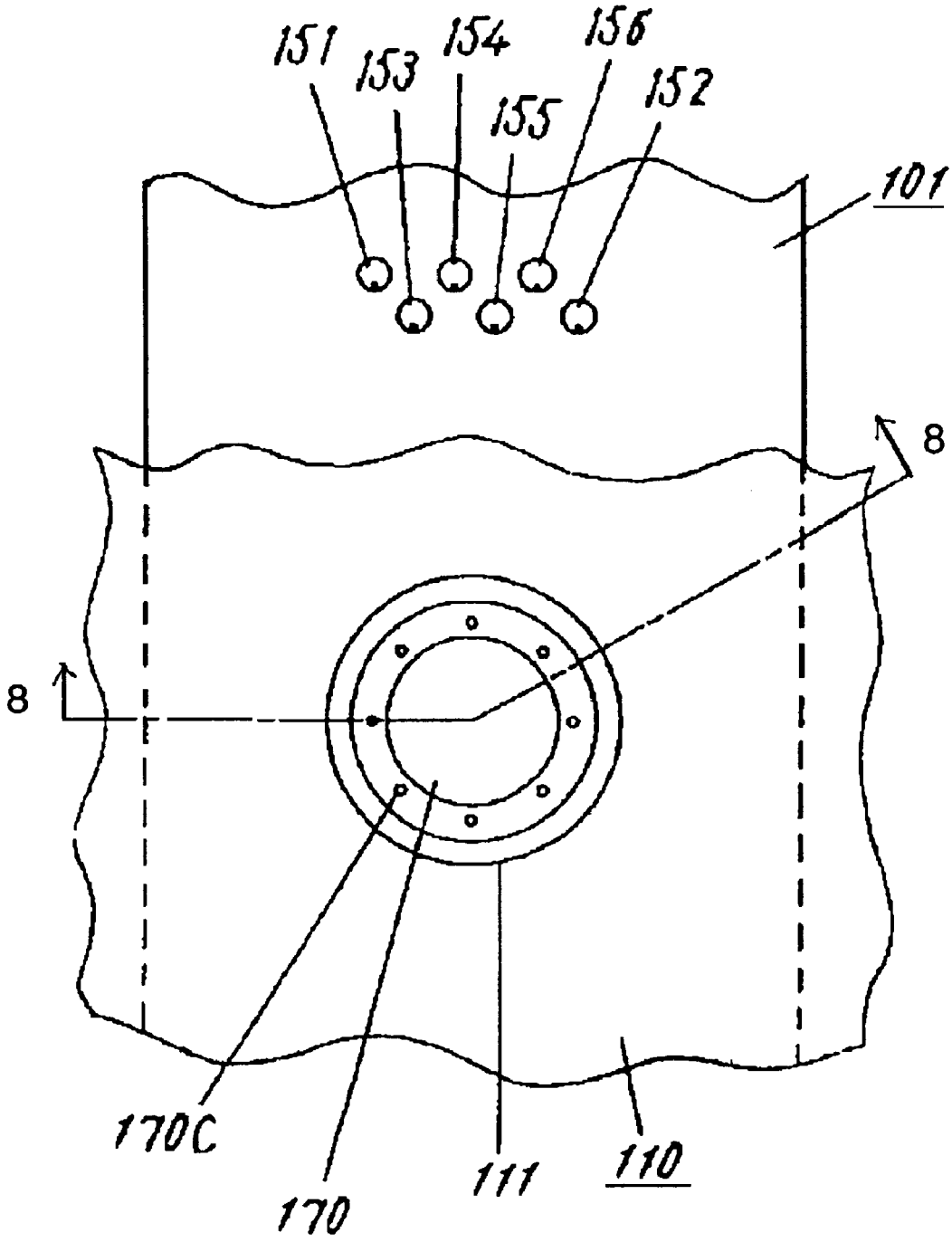
FIG. 7 is a top view of the multidirectional operation unit in accordance with the second exemplary embodiment of the present invention.

FIG. 7 is a top view of the multidirectional operation unit.

Figure 8:
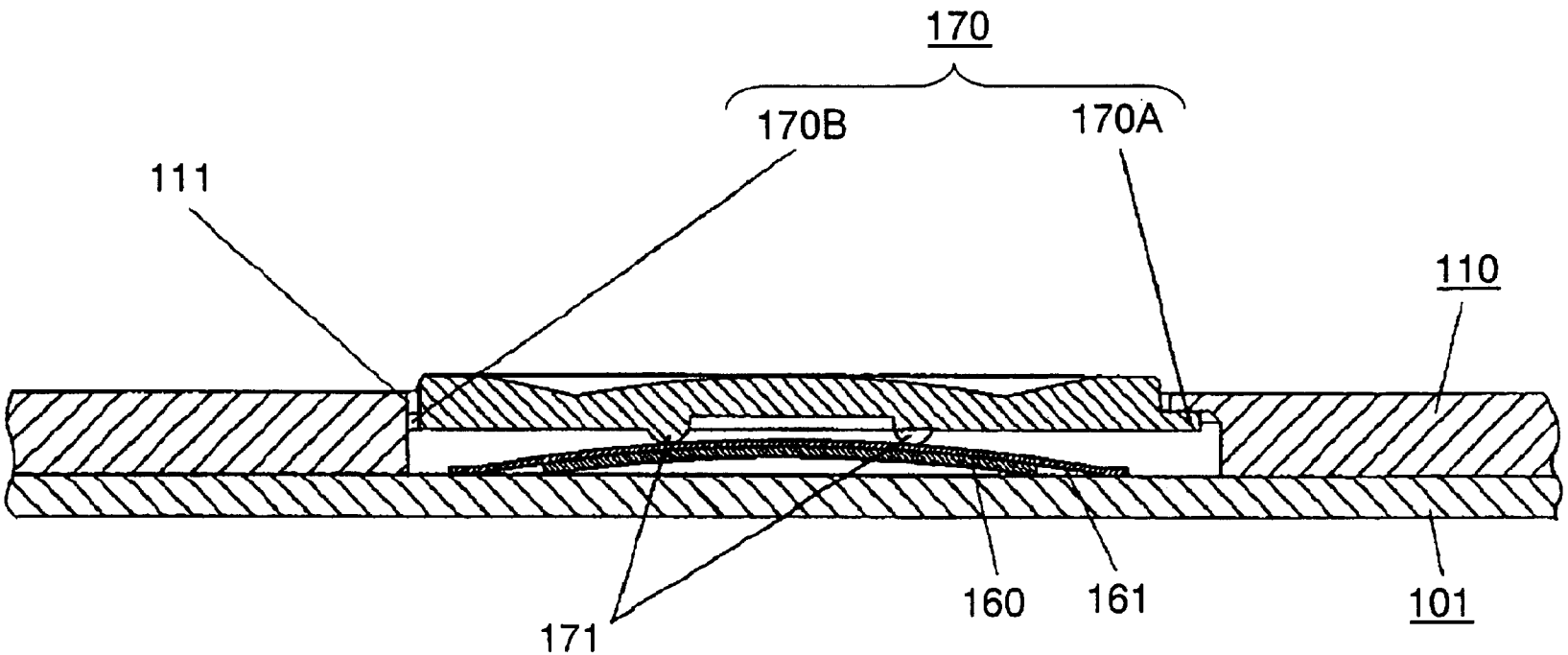
FIG. 8 is a section view taken along Line 8—8 in FIG. 7.

FIG. 8 is a section view taken along Line 8—8 in FIG. 7.

In these Figures, wiring board 101 has a multi-layer wiring structure, and is positioned by and placed in housing 110 of the apparatus. On the top face of wiring board 101, eight fixed contacts 123 to 130 are disposed for configuring the switch mechanism of the present invention.

Fixed contacts 123 to 130 are disposed toroidally at equal intervals on the circumference centering on a predetermined center, seen from the top.

These fixed contacts 123 to 130 consist of three types: two systems of common contacts, i.e., first common contacts 123 and 127 and second common contacts 125 and 129 which have electrically the same potential and are used commonly; and independent contacts 124, 126, 128, and 130 which are electrically independent.

Each contact is aligned in the clockwise sequence of first common contact 123, independent contact 124, second common contact 125, independent contact 126, first common contact 127, independent contact 128, second common contact 129, and independent contact 130.

In other words, fixed contacts 123 to 130 in the second exemplary embodiment are also aligned such that a group in the sequence of first common contact, independent contact, second common contact, and independent contact is repeated twice.

First common contacts 123 and 127 are electrically coupled inside wiring board 101, and led out by one lead-out member 151.

Second common contacts 125 to 129 are also led out by one lead-out member 152.

Electrically independent contacts 124, 126, 128, and 130 are led out by lead-out members 153 to 156 respectively.

In these Figures, other wirings and mounted electronic components which may exist are not indicated on wiring board 101.

Dome-shaped flexible contact 160 is made of a convex-shaped thin resilient metal sheet. Dome-shaped flexible contact 160 is disposed on wiring board 101 such that it includes fixed contacts 123 to 130 beneath, and is attached to wiring board 101 using flexible cover tape 161.

At this point, dome-shaped flexible contact 160 does not contact any of fixed contacts 123 to 130. The center of dome-shaped flexible contact 160 is set in the center of the circumference where fixed contacts 123 to 130 are disposed. These are the same as in the first exemplary embodiment.

The use of cover tape 161 for attaching dome-shaped flexible contact 160 ensures that dome-shaped flexible contact 160 is maintained on wiring board 101. In addition, this method makes a contact point between dome-shaped flexible contact 160 and each of fixed contacts 123 to 130 steady. Furthermore, a thin and inexpensive switch can be made feasible.

Dome-shaped flexible contact 160 which configures the switch mechanism of the present invention does not have a fixed contact which is always electrically coupled. Moreover, dome-shaped flexible contact 160 is restricted in the upward position by operation key 170 as described later. Accordingly, dome-shaped flexible contact 160 on wiring board 101 can simply be positioned by the side such as along the wall of a predetermined member.

Operation key 170 is disposed on dome-shaped flexible contact 160 via cover tape 161.

Operation key 170 is approximately disc-shaped, and is exposed from hole 111 on housing 110 so that operation key 170 is operable at its top center. Upward limiter 170A that protrudes in a circular collar shape, when seen from the top, fits to the bottom face of housing 110 to prevent operation key 170 from detaching.

Moreover, four notches 170B are created on upward limiter 170A. Tab 110A protruding downward from housing 110 is inserted through each of these notches 170B to restrict the rotation of operation key 170.

Furthermore, in the bottom surface of operation key 170, eight pushing elements 171 protruding downward are disposed at positions corresponding to respective intermediate positions between adjacent contacts among contacts 123 to 130.

As shown in FIG. 8, pushing elements 171 are disposed so as to contact the top face of dome-shaped flexible contact 160 via cover tape 161. This pushes the top face of upward limiter 170A of operation key 170 against the bottom face of housing 110 around hole 111, allowing operation key 170 to maintain its vertical neutral position.

As described above, members to limit the rotation or escape of operation key 170 are provided around hole 111 of housing 110, and are fitted to operation key 170.

This enables the apparatus height to be kept short and allowing the use of fewer components.

As shown in FIGS. 6 and 7, eight protrusions 170C for recognition during operation are disposed on the top face of operation key 170 at positions corresponding to pushing elements 171.

The center of operation key 170 to which protrusions are disposed on the circumference is disposed to the center of the circumference where fixed contacts 123 to 130 are disposed.

Notches 170B are disposed at four points on straight limes perpendicular to each other including the center of the circle on which operation key 170 is disposed, but not at points on the straight line connecting the position where protrusion 170C is disposed and the center of the circle of operation of button 170.

In the section view in FIG. 8, to simplify the drawing, only a few pushing elements 171 of operation 170 close to the section are illustrated. For the same reason, in FIG. 8, protrusions 170C of operation key 170 and fixed contacts on wiring board 101 are omitted.

The multidirectional operation unit in the second exemplary embodiment is configured as described above.

Next, the operation of this unit is described only briefly, since it is mostly the same as that of the multidirectional operation switch in the first exemplary embodiment.

First, in the normal state in which connection between any pair of the contacts is in the OFF state, as shown in FIG. 8, pressure is applied to operation key 170 from one of the protrusions 170C for recognition. Operation key 170 then tilts about a fulcrum at a top corner of upward limiter 170A at an opposing point symmetric to the pressed point. Pushing element 171 underneath protrusion 170C where the pressure is applied pushes dome-shaped flexible contact 160 via cover tape 161, and partially inverts dome-shaped flexible contact 160. Dome-shaped flexible contact 160 provides a tactile 'click' and electrically couples only between corresponding fixed contacts.

Then, when the pressure is released, pushing element 171 on the bottom face of operation key 170 is pushed up from the bottom by the resilience of dome-shaped flexible contact 160, and operation key 170 returns to its vertical neutral position. Operation key 170 returns to the normal state in which connection between contacts are all OFF.

As described above, the multidirectional operation unit in the second exemplary embodiment has fixed contacts aligned such that a group in the sequence, of first common contact, independent contact, second common contact, and independent contact is disposed repeatedly twice, in the same way as in the first exemplary embodiment. In addition, a pair of common contact and independent contact is switched by dome-shaped flexible contact 160. The direction of operation can thus be specified.

Moreover, two systems of common contacts are respectively led out to lead-out terminals 151 and 152. The small number of terminals results in greater flexibility in designing the pattern of wiring board 101. Furthermore, the use of this multidirectional operation unit makes it possible to reduce the number of input ports on control parts, such as microcomputers for signal processing.

The multidirectional operation unit in the second exemplary embodiment also contributes to the slimming of apparatuses because this unit has a simple configuration and shorter height.

A conductor other than dome-shaped flexible contact 160 is also applicable for electrically coupling fixed contacts as aligned above.

Figure 9:
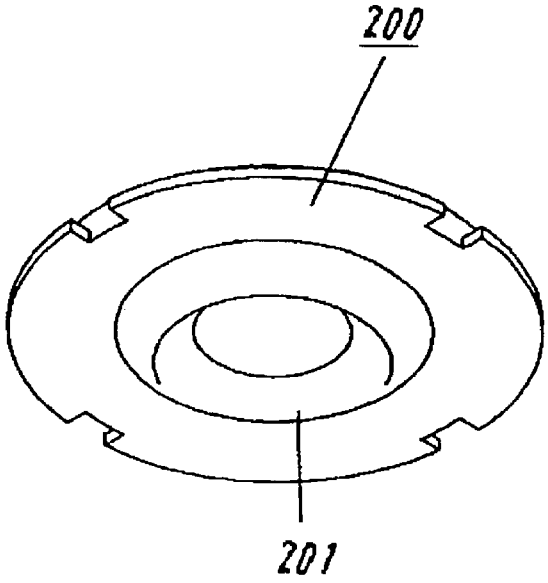
FIG. 9 is a perspective, seen from the bottom, of an operation key in another configuration in the multidirectional operation unit in accordance with the second exemplary embodiment of the present invention.
Figure 10:
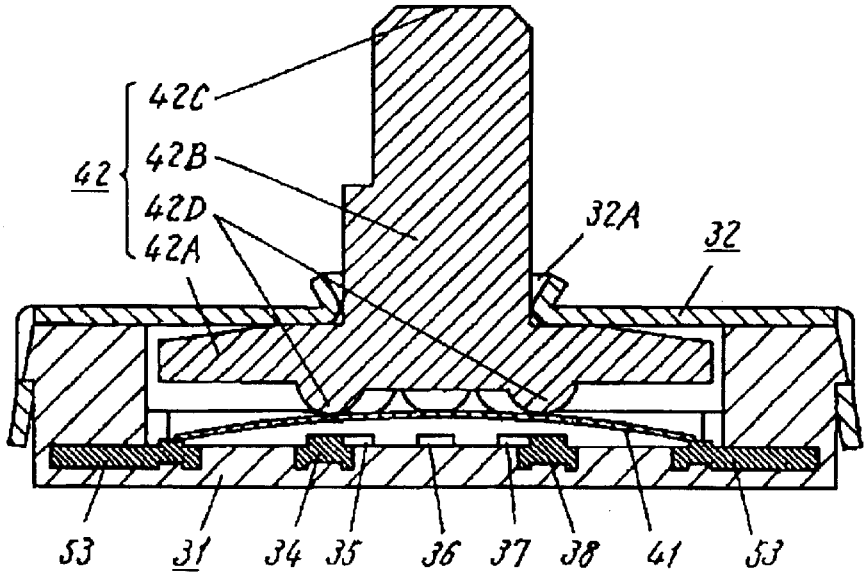
FIG. 10 PRIOR ART
FIG. 10 is a front section view of a conventional multidirectional operation switch.
Figure 11:
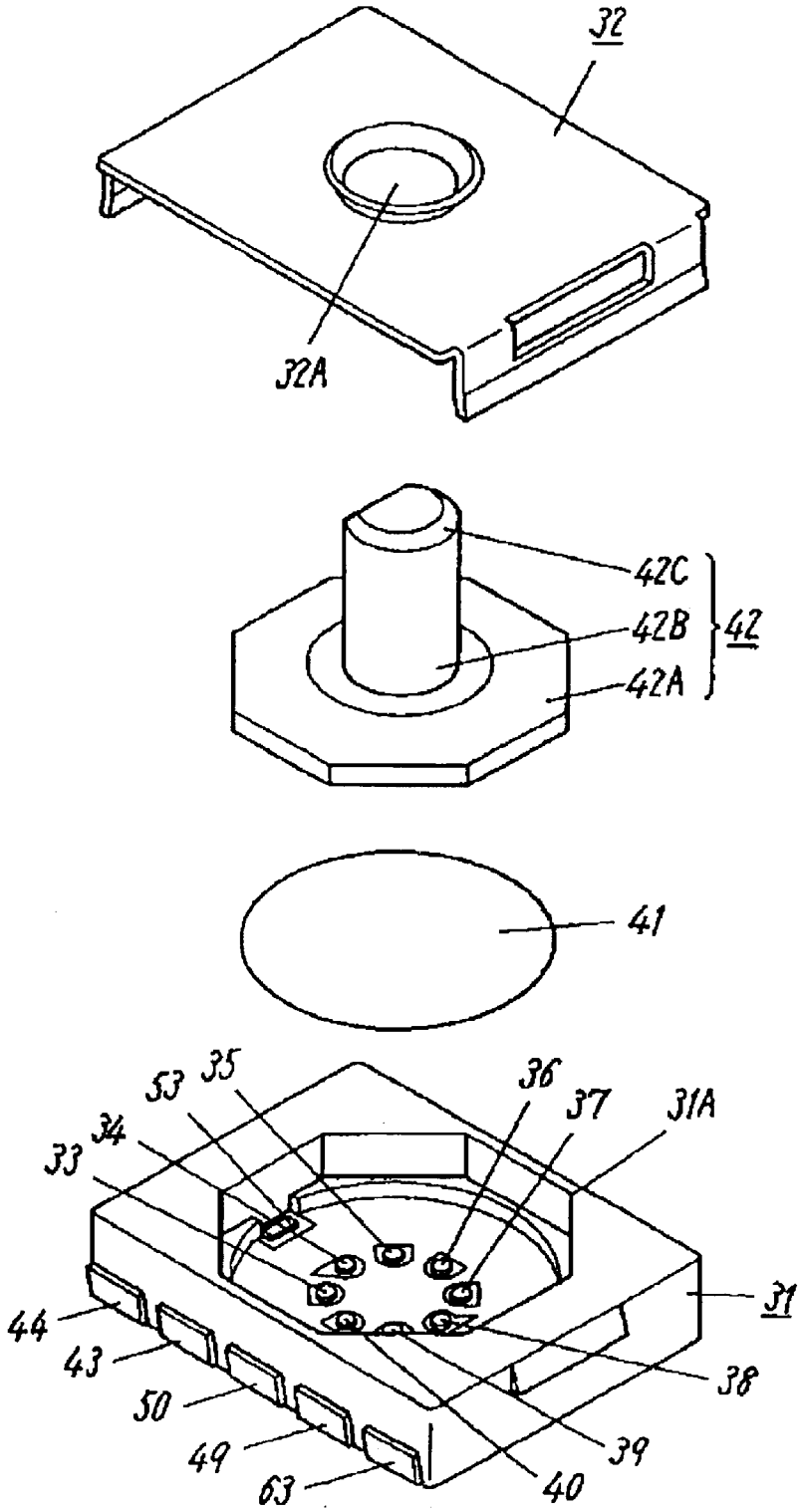
FIG. 11 PRIOR ART
FIG. 11 is an exploded perspective of the conventional multidirectional operation switch.

Operation key 200 shown in FIG. 9 is also applicable instead of operation key 170 having pushing element 171. Operation key 200 has annular pushing element 201 with a uniform height over through the circumference. As described in the first exemplary embodiment, this configuration limits the tilting movement of operation key 200 when it is pushed in the direction of the fixed contact which is not previously assigned for operation, reducing incorrect operation of the switch.

As described above, the switch mechanism of the present invention can specify operating directions using fewer fixed contacts. Accordingly, the use of this switch mechanism offers small multidirectional operation switches with fewer lead-out terminals.

Furthermore, the use of this switch mechanism offers simplified and thinner multidirectional operation units.

What is claimed is:

1. A switch mechanism comprising:

(a) a flexible contact; and (b) a plurality of fixed contacts being disposed facing said flexible contact, said fixed contacts comprising:

i) a plurality of first common contacts used commonly for electrical coupling;

ii) a plurality of second common contacts used commonly for electrical coupling; and iii) a plurality of independent contacts which are electrically independent, wherein said plurality of fixed contacts are aligned in a group of one of said first common contacts, one of said independent contacts, one of said second common contacts, and another one of said independent contacts; said group being disposed repeatedly in one of clockwise and counterclockwise sequence; and said flexible contact comes into contact with two of said fixed contacts adjacent to each other for electrically coupling said two fixed contacts.

2. A multidirectional operation switch comprising:

(a) a box case made of insulating resin, said box case having an opening at a top thereof, and a plurality of fixed contacts being disposed on an inner bottom face of said box case;

(b) a dome-shaped flexible contact made of a thin resilient metal sheet, said flexible contact being disposed inside said box case such as to cover said plurality of fixed contacts;

(c) a cover having a through hole, said cover covering said opening; and (d) an operating member including integrally molded shaft, flange, and pushing element;

said flange being formed at a bottom end of said shaft protruding from said opening, and a circumference of said flange being tiltably supported by an inner wall of said box case; and said pushing element being provided at a position respectively corresponding to each intermediate position between two adjacent fixed contacts among said plurality of fixed contacts, and being disposed on said flange in a way to contact said dome-shaped flexible contact, wherein said plurality of fixed contacts comprise:

i) a plurality of first common contacts used commonly for electrical coupling;

ii) a plurality of second common contacts used commonly for electrical coupling; and iii) a plurality of independent contacts which are electrically independent; and said plurality of fixed contacts are aligned in a group of one of said first common contacts, one of said independent contacts, one of said second common contacts, and another one of said independent contacts; said group is disposed repeatedly in one of clockwise and counterclockwise sequence; and said dome-shaped flexible contact comes into contact with two of said fixed contacts adjacent to each other by being pushed by said pushing element for electrically coupling said two fixed contacts.

3. The multidirectional operation switch as defined in claim 2, wherein said pushing element has a ring shape, and protrudes from a bottom face of said flange.

4. A multidirectional operation unit comprising:

(a) a wiring board (b) a flexible contact; and (c) a plurality of fixed contacts facing said flexible contact and being disposed on said wiring board; said fixed contacts comprising:

i) a plurality of first common contacts used commonly for electrical coupling;

ii) a plurality of second common contacts used commonly for electrical coupling; and iii) a plurality of independent contacts which are electrically independent;

wherein said plurality of fixed contacts are aligned in a group of: one of said first common contacts, one of said independent contacts, one of said second common contacts, and another one of said independent contacts; said group being disposed repeatedly in one of clockwise and counterclockwise sequence; and said flexible contact comes into contact with two of said fixed contacts adjacent to each other for electrically coupling said two fixed contacts.

5. The multidirectional operation unit as defined in claim 4 further comprising:

(d) an operation key for tilting movement, said operation key having a pushing element, wherein said flexible contact is a dome-shaped flexible contact made of a thin resilient metal sheet, said dome-shaped flexible contact is disposed on said wiring board such as to cover said plurality of fixed contacts; and said operation key is disposed on said dome-shaped flexible contact, and has said pushing element at a position respectively corresponding to each intermediate position between two adjacent fixed contacts among said plurality of fixed contacts.

6. The multidirectional operation unit as defined in claim 5, wherein said pushing element has a ring shape, and protrudes from a bottom face of said operation key.

7. The multidirectional operation unit as defined in claim 5, wherein said dome-shaped flexible contact is attached to and secured on said wiring board by a flexible cover tape having an adhesive layer on a bottom face thereof; and said pushing element is positioned on said dome-shaped flexible contact via said cover tape.

8. The multidirectional operation unit as defined in claim 5, wherein said operation key being positioned and limited of rotation and escape by fitting said operation key to a positioner provided around said hole on said housing.

* * * * *